US005419706A

United States Patent [19]

Levy et al.

[11] Patent Number: 5,419,706

[45] Date of Patent: May 30, 1995

[54] APPARATUS FOR FORMING IMAGES OF NON-VISIBLE ELEMENTS UNDERLYING AN OPAQUE SURFACE

[76] Inventors: Richard C. Levy, P.O. Box 34828, Bethesda, Md. 20827; Richard J. Maddocks, 302 Lexington Dr., Silver Spring, Md. 20901

[21] Appl. No.: 79,816

[22] Filed: Jun. 22, 1993

[51] Int. Cl.[6] ..... B43L 1/00

[52] U.S. Cl. ..... 434/409; 434/274; 434/267; 446/134; 446/129

[58] Field of Search ..... 434/409, 408, 427, 428, 434/330, 301, 168, 262, 267, 274; 446/13.4, 132, 133, 129; 283/82, 72

[56] References Cited

U.S. PATENT DOCUMENTS

| | | | |
|---|---|---|---|
| 2,427,210 | 9/1947 | Harding | 446/132 |
| 2,427,442 | 9/1947 | Campbell | 446/132 |
| 2,589,601 | 3/1952 | Burnett | 434/409 |
| 3,140,712 | 7/1964 | Hunter . | |
| 3,509,644 | 5/1970 | Santell et al. . | |
| 4,115,315 | 9/1978 | Marinelli . | |
| 4,143,472 | 3/1979 | Murata et al. . | |
| 4,394,287 | 7/1983 | Scarpelli . | |
| 4,643,684 | 2/1987 | Murata et al. . | |
| 5,006,000 | 4/1991 | House . | |
| 5,018,979 | 5/1991 | Gilano et al. . | |
| 5,112,229 | 5/1992 | Gilano et al. . | |

FOREIGN PATENT DOCUMENTS 1023457 12/1977 Canada .

*Primary Examiner*—Gene Mancene
*Assistant Examiner*—Jeffrey A. Smith
*Attorney, Agent, or Firm*—Nixon & Vanderhye

[57] ABSTRACT

Apparatus for forming an image on a scanner includes a scanning screen formed of ferrofluidic material and one or more magnetic elements shaped to form a defined peripheral outline(s). The magnetic elements are disposed on one side of a surface and are not visible from the opposite side of the surface. By locating the scanner on the opposite side of the surface, the magnetic flux lines of the magnetic elements orient the magnetic particles of the ferrofluidic screen and alter its light transmission characteristics of the screen whereby an image of the outline of the magnetic elements is provided.

20 Claims, 4 Drawing Sheets

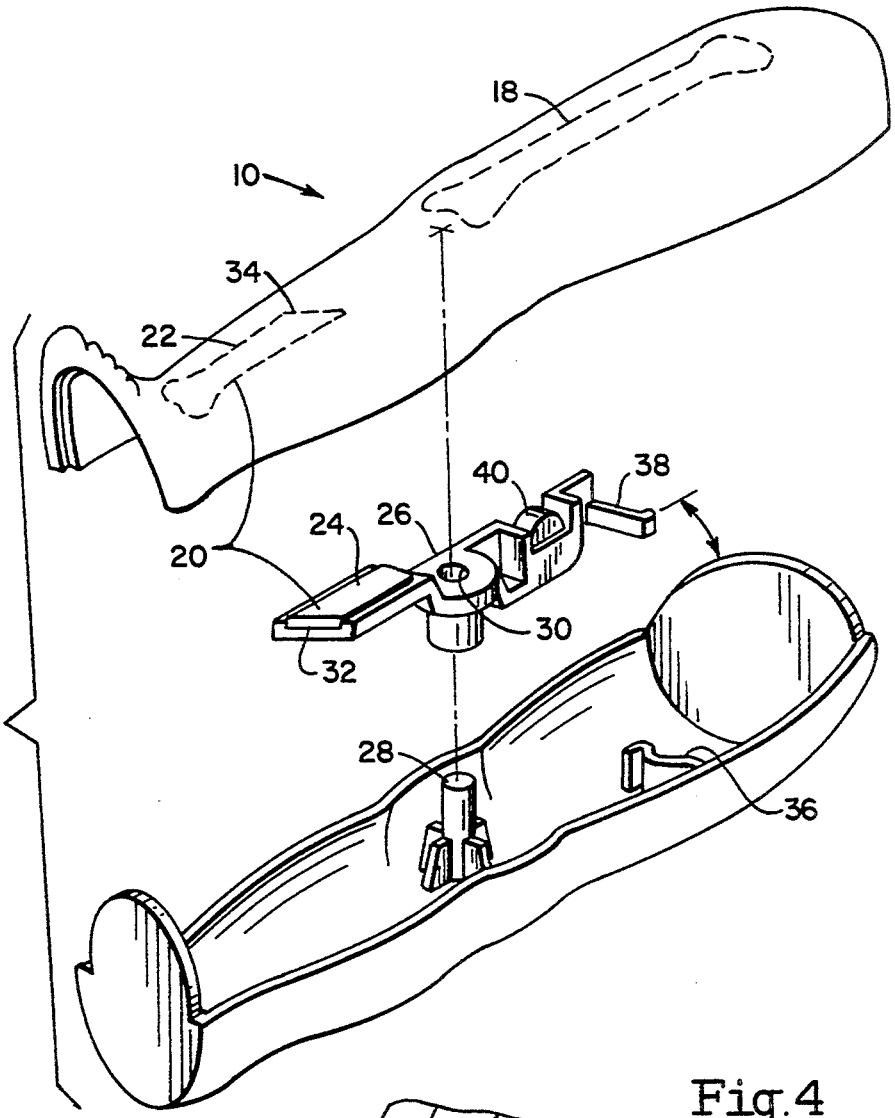
Fig.2
Fig.3
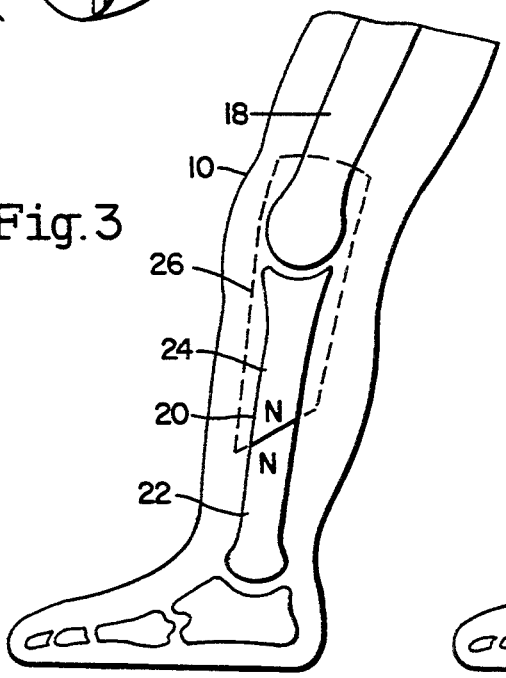
Fig.4
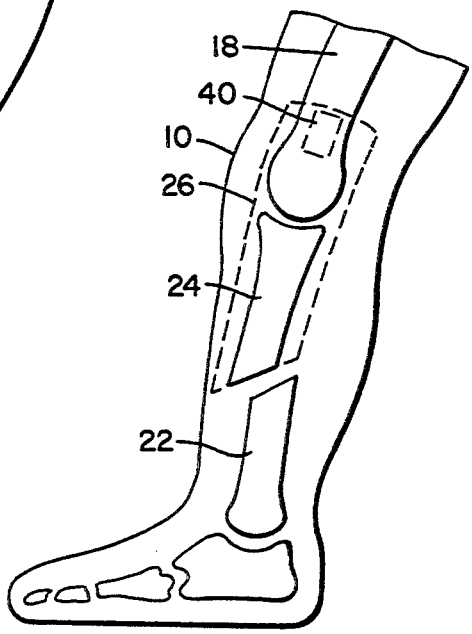

Fig.5
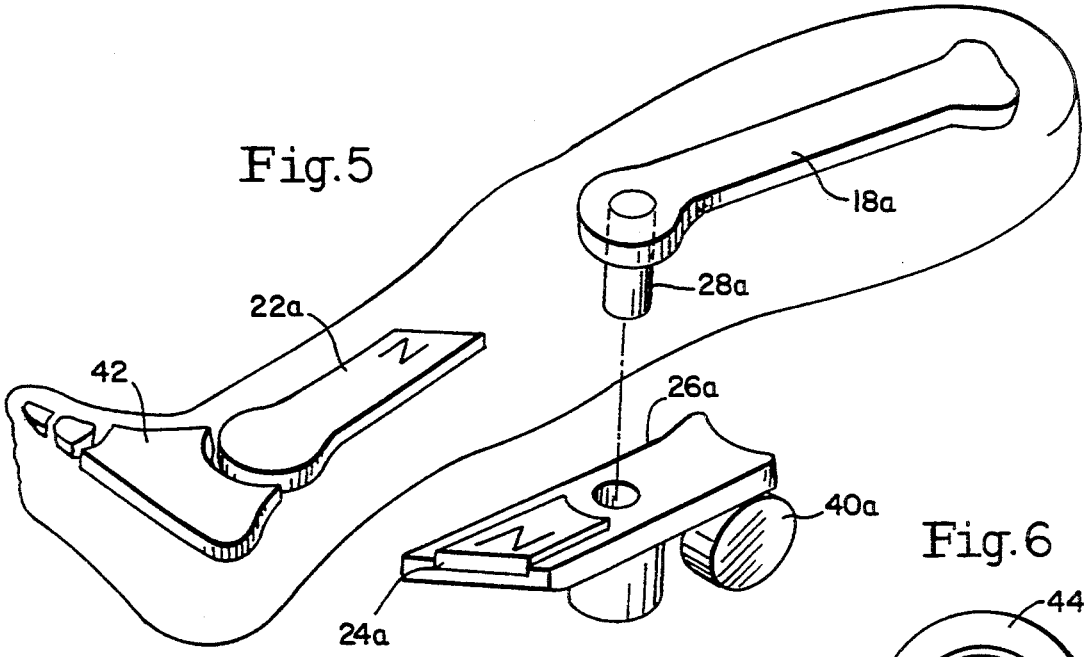
Fig.6
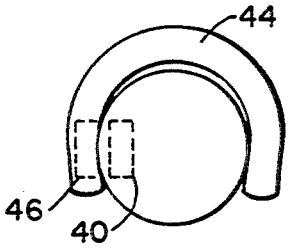
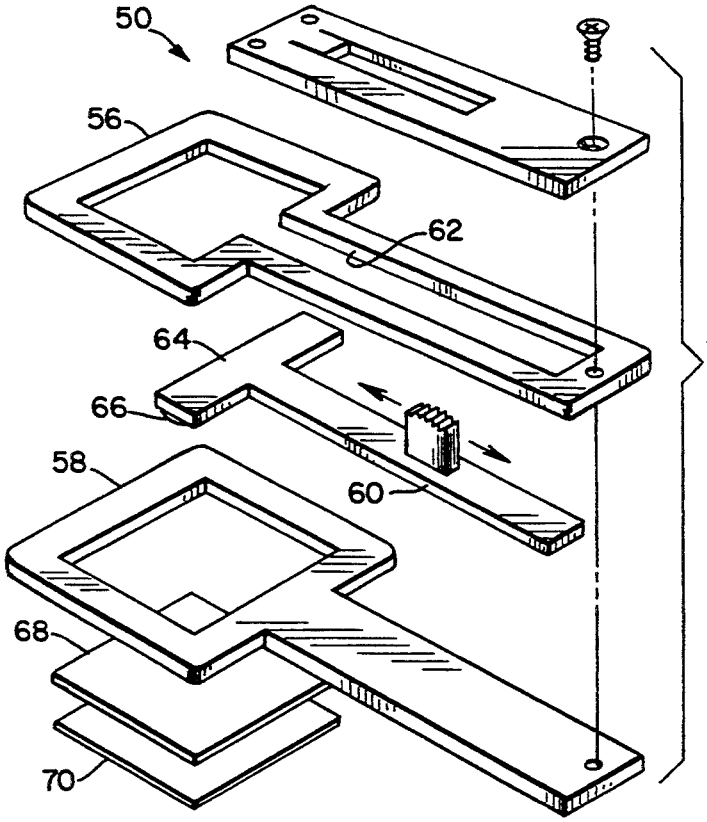
Fig.7
Fig.8
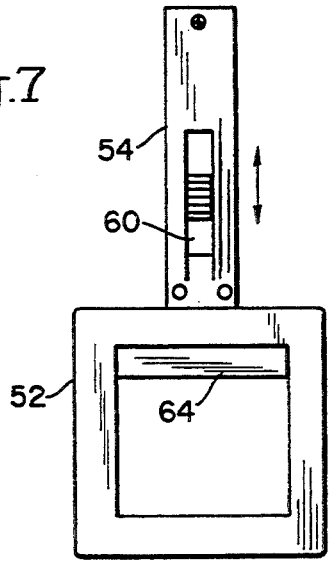
Fig.9
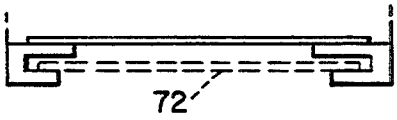

APPARATUS FOR FORMING IMAGES OF NON-VISIBLE ELEMENTS UNDERLYING AN OPAQUE SURFACE

TECHNICAL FIELD

The present invention relates to the formation of images on a scanning screen of elements otherwise not visible behind an opaque surface and particularly relates to one or more magnetic elements for generating a magnetic field in combination with a ferrofluidic screen for forming images of the elements on the screen on a side of an opaque surface opposite the magnetic elements. Particularly, the present invention relates, in a preferred embedment, to the formation of simulated X-ray images of the internal skeletal parts of a toy, for example, a bone in the leg of a toy doll.

BACKGROUND

Ferrofluidic screens and magnets for forming images on the screens are known. In such apparatus, magnetically active particles are disposed in a dispersion medium which substantially precludes travel of the particles throughout the medium yet permits the particles to orient themselves under the influence of a magnetic field. The dispersion medium and particles are typically disposed within an enclosure with at least one side of the enclosure forming a transparent or translucent screen. When a magnetic field is imposed on the magnetically active particles, the particles will orient or align themselves in the dispersion medium along the flux lines of the magnetic field. This alters the light transmission characteristics through the screen. The ferrofluidic screens were primarily developed for industrial application to display the magnetic field of magnetized materials (such as multi-pole magnets) as an aid for quality control during the production of magnets. A typical use of a ferrofluidic screen is to imploy a magnet in the form of a pen such that the pen, when moved along the screen surface, aligns the magnetically active particles to form an image, i.e., the magnetic pen writes on the ferrofluidic screen. The present invention adapts the ferrofluidic screen and magnet phenomena to a scanning apparatus for viewing from one side of an opaque surface element otherwise not visible on the opposite side of the surface.

DISCLOSURE OF THE INVENTION

Generally, and in accordance with the present invention, the present invention provides, in combination, a scanner including a ferrofluidic screen, magnetic elements and an article having an opaque surface. The scanner is typically not attached to the article carrying the opaque surface being scanned but could be attached to the article if desired. The surface of the article is generally opaque such that the magnetic element or elements behind the surface are not visible from in front of the surface. The element or elements behind the surface may comprise one or more magnets formed in a predetermined outline. The magnets may comprise any type of magnetic material, such as permanent metal magnets, magnetic inks, magnetic paint, magnetic tape, and may be rigid or flexible, as desired. By forming an outline of the desired shape from magnetic material, including shapes or openings within the magnetic material, various types of information can be conveyed when images of the elements are viewed in accordance with the present invention from the side of the opaque surface remote from the elements.

For example, and in a preferred embodiment of the present invention, the magnetic material may be formed into a readily identifiable shape such as the shape of a letter, animal, symbol or the like. The resulting shaped magnetic element may then be disposed on an opaque surface or within a body wherein the element is not visible when viewed from the opposite side of the surface or body. By passing the scanner with the ferrofluidic screen along the opposite side of the opaque surface or body, the magnetic field generated by the shaped magnetic element orients the magnetic particles of the ferrofluidic screen into alignment with the flux lines of the magnetic field, thus altering the light transmission characteristics of the screen and forming an image of the element on the screen. The image formed on the screen is analogous to or simulative of an X-ray image of the shaped element.

As a specific example, one or more magnetic elements may be disposed on the page of a book. A label or other surface may be disposed overlying the shaped magnetic element(s). The overlying label or surface may have surface characteristics related to the underlying shape of the magnetic element. For example, the armor cladding of a dinosaur may be pictorially represented on the overlying label while the skeletal structure of the dinosaur may be formed of magnetic material underlying the label. When the scanner is brought into overlying relation with the label, the magnetic interaction of the flux lines and magnetic particles alters the light transmission characteristics of the screen to form an image of the skeleton on the screen which may be viewed by the individual holding the scanner.

The scanner may comprise a support or wand mounting a ferrofluidic screen having a transparent or translucent surfaces on opposite sides. The wand has a handle facilitating manual manipulation of the screen to overlie a surface underlying which magnetic material previously formed into a predetermined shape is disposed. Of course, the scanner may form a permanent part of an article being scanned. Additionally, the nature of ferrofluidic screens is such that the image is retained on the screen when the scanner is removed from the influence of the magnetic field. To enable the scanner to be used to visualize additional images, the image on the scanner may be erased. For that purpose, the scanner carries a magnet which can be moved across the screen to orient the magnetically active particles of the screen in a predetermined manner such that the light transmission characteristics of the screen are substantially uniform across the entire screen. Thus, the screen is ready for scanning an additional object. To provide a permanent record of the scanned object, a second ferrofluidic screen may be carried by the scanner. The second screen may be removably mounted on the scanner. In that manner and when removed from the scanner, the second screen affords a permanent record of the image, while the first screen may be erased as previously described and used again.

In a preferred embodiment of the present invention, the scanning apparatus is provided in conjunction with a toy doll for purposes of identifying whether or not certain skeletal bones of the toy doll are broken. For example, magnetic material may be formed into two elements, the combination of which forms an outline of a simulated tibia between the knee and ankle of one or both of the doll's leg. The first element, for example, may comprise a flexible magnet in the form of magnetic tape secured along the inside surface of the shell forming the doll's leg and extending from the ankle a predetermined distance intermediate the ankle and knee. A second flexible magnet may be mounted on a movable member, preferably pivotally secured to the doll's leg. The member is movable between first and second positions. In a first position, the second magnetic element lies adjacent to and in alignment with the first element to form an outline of a typical normal tibia. Movement of the member into the second position, however, displaces the otherwise adjoining ends of the elements, thereby simulating a break in the tibia. To accomplish this, the member may be detented in the first position and movable into the second position upon impact of the doll's body or leg against a surface, for example, when the doll is dropped. Preferably, the member is maintained in the second position by like poles of the magnets at the juncture of the two elements.

In play, a child may initially place the scanner over the doll's leg when the two elements are lightened and see an image on the scanner simulative of a completely normal unbroken tibia. Should the doll be dropped or impacted upon causing the member to move from the detented position, the element obtains a second position and the child may similarly scan the leg of the doll with the scanner. In doing so, the discrete outlines of the tow magnetic elements will appear as images on the scanner, indicating a space between the two elements and hence a broken tibia bone. To set the bone back into its normal position, the child may place a cast in the form of a generally elongated U-shaped member over the doll's leg. By mounting magnets in the member and the pivotal member which repel or attract one another, depending upon their relative location, the placement of the cast over the doll's leg pivots the member and carries the second element back to its first detented position. Upon removal of the cast, the child may then scan the doll's leg to determine whether or not the tibia has been properly set.

It will be appreciated that the scanning apparatus hereof can be used in like manner for imaging other skeletal parts of the doll's body. Also, various changing images from within the doll's body can be imaged on the scanner. For example, the scanner may be used as a sonogram to visualize the growth of baby within the doll's body. To accomplish this, a disk having consecutively enlarged outlines of the baby's body in various stages of development may be formed of magnetic material and supplied on a carousel within the doll body. The carousel may be rotated to successively register the magnetic elements simulative of the baby at a specified location on the doll's body. By placing the scanner in overlying relation of the doll's body at that specified location, images of the baby's forming body appear on the scanner. The remaining non-registering differently shaped magnetic elements simulative of different degrees of formation of the baby's body may be masked from the scanner by interposing a masking material, such as tin, between the carousel and the scanner or, preferably, the shell of he doll body. This masking would substantially inhibit magnetic lines of flux from the non-registering baby-shaped magnetic elements form passing through the shell of the doll's body.

Many other uses of the apparatus of the present invention will readily come to mind to those of skill in this art. For example, the invention is useful in publishing children's books where the magnetic elements may be shaped to form certain images, letters, words, animals or the like. Those shapes can be hidden from view by an overlay of other informative material. When scanned, the images formed by the magnetic elements and otherwise not visible, will appear on the scanner, complementing any information given on the overlying surface or label. The scanner may form part of the book or be separate from the book. Magazine covers, cereal boxes or the like may comprise the materials on which the scanning apparatus of the present invention may also be used.

In a preferred embodiment according to the present invention, there is provided an image forming apparatus comprising a member having an opaque surface, an element underlying the surface such that the element is not visible through the surface, the element comprising a magnet for generating a magnetic field and a scanner including a support having a screen carrying a plurality of magnetically active particles in a dispersion medium such that, when the screen overlies the surface, the magnetic field acts on the particles carried by the screen to align the particles and thereby alter the light transmission characteristics of the screen to form a visible image of the element on the screen.

In a further preferred embodiment according to the present invention, there is provided a toy doll comprising a toy doll having an opaque surface, an element underlying the surface such that the element is not visible through the surface, the element comprising a magnet for generating a magnetic field and a scanner including a support having a screen carrying a plurality of magnetically active particles in a dispersion medium such that, when the screen overlies the surface of the doll body, the magnetic field acts on the particles carried by the screen to align the particles and thereby alter the light transmission characteristics of the screen to form a visible image of the element on the screen.

Accordingly, it is a primary object of the present invention to provide a novel and improved scanning apparatus employing ferrofluidic screens providing simulated images on one side of an opaque surface of shaped magnetic elements on the opposite side of the surface and otherwise not visible from the one side of the surface.

BRIEF DESCRIPTION OF THE DRAWINGS

FIG. 2 is an enlarged exploded perspective view with parts broken out of a leg of the doll body illustrated in FIG. 1 illustrating one embodiment of the present invention;

FIG. 3 is a fragmentary side elevational view schematically illustrating the location of the magnetic elements within the doll body's leg with such elements simulating the tibia bone in an unbroken condition;

FIG. 4 is a view similar to FIG. 3 illustrating a simulated tibia bone in a broken condition;

FIG. 5 is a fragmentary perspective view of the interior of the doll body's leg in a slightly different form than illustrated in FIG. 2;

FIG. 6 is a cross-sectional view of an elongated member simulative of a leg cast for disposition over the doll's leg illustrated in the previous figures;

FIG. 7 is an exploded perspective view illustrative of various parts of a scanner according to the present invention;

FIG. 8 is a plan view of the scanner;

FIG. 9 is a cross-sectional view thereof illustrating another embodiment of the scanner;

BEST MODE FOR CARRYING OUT THE INVENTION

Reference will now be made in detail to a present preferred embodiment of the invention, an example of which is illustrated in the accompanying drawings.

Figure 1:
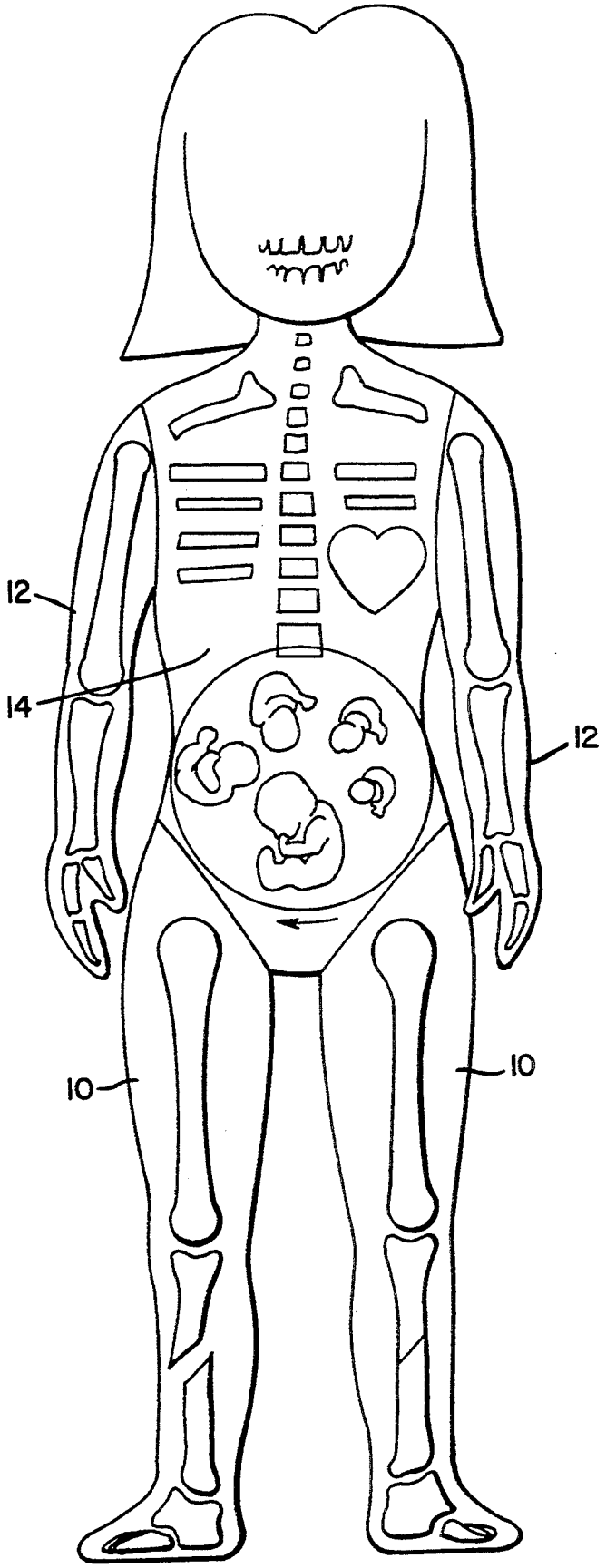
FIG. 1 is a schematic illustration of a toy doll illustrating various embodiments of the present invention.

Referring now to the drawings, particularly to FIG. 1, there is illustrated a play doll, which may be of any typical conventional construction, having limbs including legs 10, arms 12 and a body portion or torso 14. Typically, the doll body may be formed of a plastic material and is hollow along its interior. Various internal areas of the doll's body may be imaged on the scanner. For example, various skeletal parts of the human body may be simulated by use of shaped magnetic materials on the inside of the doll's body, otherwise not visible external to the body, but visible only by the image on the scanner, as will become clear from the ensuing description.

In FIG. 2, there is illustrated opposite halves of the leg 10 of the doll body of FIG. 1, incorporating within the leg a portion of the scanning apparatus according to the present invention. The apparatus hereof includes one or more magnetic elements shaped or formed in the outline of the skeletal portions of the leg. For example, flexible magnetic tape may be cut to have an outline simulating the femur 18 of the human body. Likewise, magnetic tape may be shaped to form an outline simulating the tibia 20 between the femur and ankle bones. In this example, the magnetic tape simulating the tibia 20 comprises first and second discrete elements 22 and 24, respectively. The first element 22 is taped or adhesively secured along the underside or interior of the shell or body of the doll's leg in the appropriate position to simulate the location of that portion of the tibia in the doll's leg. The second element 24 formed of magnetic tape is mounted on a member 26 movable between first and second positions. Preferably, the member 26 is pivotally mounted on a pin 28 received in an opening 30 centrally of the member 26 whereby the member 26 pivots about pin 28. Thus, the second element 24 is movable between first and second positions illustrated in FIGS. 3 and 4, respectively. When the second element 24 lies in the first position, as illustrated in FIG. 3, it will be appreciated that the edge 32 of element 24 lies closely adjacent the edge 34 of first element 22 whereby the elements combined simulate a complete, unbroken, normal tibia bone. When the element 24 is moved into the second position illustrated in FIG. 4, the edges of the first and second elements 22 and 24, respectively, are spaced from one another forming a break in their outline and simulating a break in the tibia bone.

The member 26 is detented such that the second element 24 lies in the simulated normal unbroken condition illustrated in FIG. 3. To accomplish that, a projection 36 within the leg body cooperates with a flexible lever arm 38 at the distal end of member 26 to maintain the member 26 in the position illustrated in FIG. 3. Should an impact for force be applied to the leg or other part of the doll, e.g., if the doll is dropped, or a mechanism, not shown, activated to pivot member 26, the second element 24 may be pivoted from the detented position of FIG. 3 into the position illustrated in FIG. 4 spacing adjacent edges 32 and 34 from one another simulative of a break in the simulated tibia bone of the doll's leg. By locating like poles adjacent the edges 32 and 34 of the magnetic elements 22 and 24, the repelling force of the like poles will tend to maintain the member 26 in the position illustrated in FIG. 4. Other mechanisms may be used to maintain the element 24 in the second position illustrated in FIG. 4, such as an additional detent or springs or magnets, as will be appreciated by those of skill in the art. For purposes which will become clear, a permanent magnet 40 is carried by the member 26.

Referring now to FIG. 5, there is illustrated a further form of the doll's leg wherein the ankle bones are simulated by flexible magnetic tape 42 cut into the outline of the ankle. The member **26*a* is pivoted below a pin 28*a*, mounting a fixed magnet 18*a*, suitably secured within the body of the doll's leg. As in the prior embodiment, a fixed permanent magnet 22*a* is carried by the leg simulating the lower portion of the tibia, while a fixed permanent magnet 24*a* is carried for pivotal movement on the member 26*a* between first and second positions. As in the prior embodiment, a permanent magnet 40*a* is carried on the element 26*a***.

Referring to FIG. 6, there is illustrated a member 44 simulative of a cast for the leg of the doll between the knee and ankle. The cast is preferably of U-shaped cross-section such that the doll's leg may be received within the cast 44. A permanent magnet 46 is mounted in the side of the cast 44 for cooperation with the permanent magnet 40 or **40*a***, as will be described.

Referring now to FIGS. 7 and 8, thee is illustrated a scanner, generally designated 50, constructed in accordance with the present invention. Fundamentally, the scanner includes a body having a head 52 and a handle 54, the body 52 having a central opening in the form of a square or rectangle. In this schematically illustrated form, the scanner includes upper and lower frames 56 and 58 and a T-shaped member 60 for disposition between frames 56 and 58. Frames 56 and 58 have registering square or rectilinear openings whereby, upon lamination together, the T-shaped member 60 fits within a slot 62 in upper frame 56 with the base 64 of the T-shaped member located within the square or rectangular opening. The base 64 carries a permanent magnet 66. Attached to the underside of the lower frame 58 is a clear transparent, preferably plastic screen, underneath which is mounted a ferrofluidic screen 70. As will be recalled, the ferrofluidic screen is comprised of magnetic particles disposed in a dispersion medium within an enclosure comprised of transparent or translucent screens on opposite sides. For a complete description of the ferrofluidic screen, attention is directed to U.S. Pat. No. 5,112,229, which discloses and discusses the composition an properties of ferrofluidic screens in general. The disclosure of U.S. Pat. No. 5,112,229, dated May 12, 1992, is incorporated herein by reference. It is sufficient for present purposes to note that the magnetic particles in the dispersion medium will align with any magnetic flux lines to alter the light transmission characteristics of the screen. Thus, where the magnetic particles have been altered, there is a contrast visible on the screen between the unaltered particles and the altered particles, which affords an image corresponding to the peripheral outline of the magnetic element generating the magnetic flux lines.

Referring to FIG. 9, the scanner may have an additional slot, for example, along its underside, to receive an additional ferrofluidic screen 72. The secondary ferrofluidic screen 72 is removable from the scanner and, as will become clear, affords a permanent record of the image received by the scanner when used.

To sue the scanning apparatus of the present invention, an individual or child may place the screen of the scanner 50 along the doll's leg. Because of the magnetic interaction of the magnetic liens of flux and the magnetic particles in the ferrofluidic screen, an image in the form of an outline of the magnetic elements within the leg is formed on the screen. It will be appreciated that when the screen overlies the surface of the doll's leg adjacent the ankle, the outline of the first element 22 will appear on the screen. Similarly, the outline of the second element 24 and the tape 18 simulating the femur bone will likewise appear when the scanner is placed in juxtaposition along the outside of the doll's leg in opposition to those magnetic elements. Thus, the child or individual may locate the scanner adjacent the adjoining edges 32 and 34 of the second and first elements 24 and 22, respectively, when the second element lies in its first position and ascertain, by viewing the image on the screen, that the elements 22 and 24 simulating the tibia bone are aligned one with the other. The image thus provided simulates an unbroken tibia. Should the doll be dropped or an impact applied to the doll or some other mechanical or inertial mechanism applied to pivot member 26, wit will be seen that the member 26 pivots from the position illustrated in FIG. 3 to the position of FIG. 4. In the position of FIG. 4, the second element 24 is spaced from the first element 22 and the edges 32 and 34 thereof define a discernible gap simulative of a broken tibia. The scanner 50 may then be located along the outside of the doll's leg in registration with that area and the break in the elements 22 and 24 and particularly the spacing of the edges 32 and 34 can be readily ascertained in the image formed on the scanner.

Once the child has ascertained that the doll's leg is broken, as viewed in the scanner, the cast 44 illustrated in FIG. 6 may be disposed about the doll's leg. When so disposed, the magnet 46, which may have a different pole as the magnet 40 or 40*a* whereby, upon disposition of cast 44 over the doll's leg, the attracting forces of these magnets cause the member 26 to pivot into its first position, i.e., its detented position illustrated in FIG. 3. In that position, the second element 24 is rotated back into alignment with the first element 22, simulating an unbroken tibia bone in the doll's leg. The cast may then be removed and the scanner disposed along the doll's leg to ascertain that the break has been cured.

Figure 10:
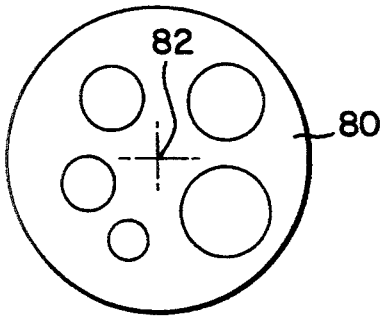
FIG. 10 illustrates a carousel mounted for rotation within the doll's body of FIG. 1 and carrying magnetic elements in certain shapes.
Figure 11:
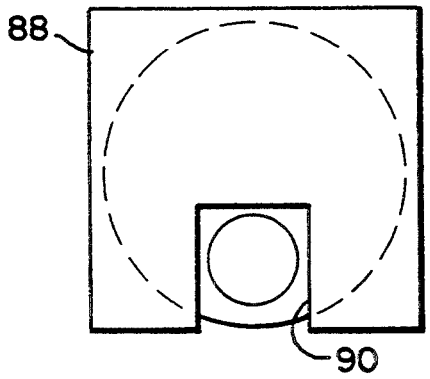
FIG. 11 is a view of the carousel with a masking element and the scanner in place.

Referring now to FIGS. 1, 10 and 11, there is illustrated in further embodiment of the present invention. In this embodiment, a carousel 80 is carried within the doll body for rotational movement about axis 82. Spaced circumferentially one from the 9other about the carousel are a series of magnetic elements shaped progressively to simulate a portion of the human body. In this instance, for example, the magnetic elements may be sequentially shaped in the form of a simulated baby to indicate the various stages of its growth. Overlying the carousel 80 and spaced between it and a portion of the doll body to be scanned is a masking material 88. The material may comprise, for example, tin and have a slot 90 in which the various magnetic elements may register upon rotation of the carousel. The shell of the doll's body, of course, overlies the mask and carousel. Consequently, when the child wishes to observe one of the magnetic elements, the scanner is placed over the appropriate portion of the doll's body, i.e., the slot 90, and an image is formed on the screen simulative of the shape of the magnetic element. Upon rotation of the carousel by suitable means, for example, by rotating a dial exposed through a slot in the doll body, each of the magnetic elements may be progressively registered with the opening or slot 90 such that its outline may be formed as an image on the scanner. It will be appreciated that the masking material 88 precludes the scanner from recording images of the magnetic materials not in registration with opening 90.

Figure 12:
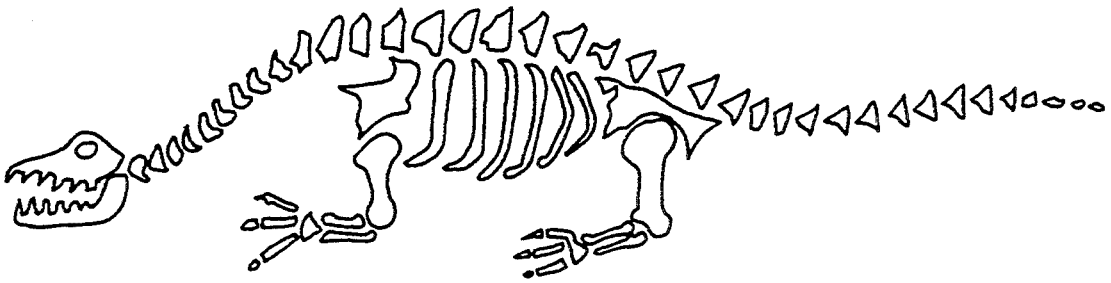
FIG. 12 is a view of a skeletal body of a dinosaur as applied to the page of a book.
Figure 13:
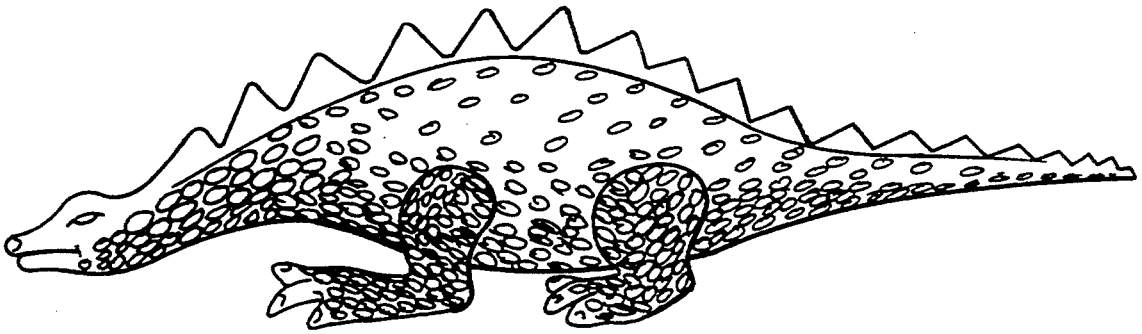
FIG. 13 is a cross-sectional view illustrating an opaque surface overlying the skeletal frame of the dinosaur and the scanner in place such that the individual can image the dinosaur skeleton on the scanner.

Referring now to FIG. 12, there is illustrated a further form of the scanner apparatus of the present invention, for example, for use as part of a book. On the page of the book, magnetic elements, for example, in the form of magnetic tape, are shaped and arranged on the book to form the desired outline. In this example the skeletal outline of a dinosaur is illustrated. Obviously, other shapes could be formed, such as letters, names, or other animals or objects. A surface, for example, a label may be disposed over the magnetic element and is secured to the page of the book. In this instance, for example, the label may carry a picture of the dinosaur with its outer body or cladding. If the child wishes to observe the skeletal parts of the dinosaur, the scanner is placed in position overlying the dinosaur and, as in the previous embodiments, the magnetic flux lines orient the magnetic particles in the scanner to alter the light transmission characteristics such that an image of the underlying magnetic element is formed on the scanner.

While the invention has been described with respect to what is presently regarded as the most practical embodiments thereof, it will be understood by those of ordinary skill in the art that various alterations and modifications may be made which nevertheless remain within the scope of the invention as defined by the claims which follow.

What is claimed is:

1. Image forming apparatus comprising:

a member including an opaque surface;

an element carried by said member and underlying said surface such that said element is not visible through said surface, said element comprising a magnet for generating a magnetic field passing through said opaque surface; and a scanner including a support having a screen for overlying said surface and carrying a plurality of magnetically active particles in a dispersion medium, said magnetically active particles being responsive to said magnetic field, when said screen overlies said surface, such that said magnetic field acts on said particles carried by said screen to align said particles and thereby alter the light transmission characteristics of said screen to from a visible image of said element on said screen.

2. Apparatus according to claim 1, including a second element carried by said member and underlying said surface such that said second element is not visible through said surface, said second element comprising a magnet for generating a magnetic field, said screen being of a size such that, when said screen overlies said surface, said magnetic field of said second magnetic element acts on said particles carried by said screen to align said particles and thereby alter the light transmission characteristics of said screen to form a visible image of said second element on said screen simultaneously with the formation of the visible image of said first element.

3. Apparatus according to claim 2 wherein said second element is movably carried by said member for movement relative to said first element between a first position adjacent said first element and a second position spaced from said first element, said screen being of a size to overlie said surface with at least portion of said first and second elements forming an image on said screen when said second element lies in said first and second positions.

4. Apparatus according to claim 3 wherein said first and second elements in said first position of said second element lie adjacent one another such that the magnetic fields of the magnets thereof act on said particles to align said particles and thereby alter the light transmission characteristics of said screen to form a substantially continuous visible image of said elements without any substantial image of a juncture between said elements.

5. Apparatus according to claim 4 wherein said second element is detented in said first position and is movable from said first position into said second position in response to an impact against the member.

6. Apparatus according to claim 3 wherein said first and second elements in said second position of said second element lie spaced from one another such that the magnetic fields of the magnets thereof act on said particles to align said particles and thereby alter the light transmission characteristics of said screen to form discrete discontinuous images of said elements with spacing therebetween.

7. Apparatus according to claim 3 wherein said first and second elements in said first position of said second element lie adjacent one another such that the magnetic fields of the magnets thereof act on said particles to align said particles and thereby alter the light transmission characteristics of said screen to form a substantially continuous visible image of said elements without any substantial image of a juncture between said elements, said second element being detented in said first position and movable from said first position into said second position in response to an impact against the member, said first and second elements in said second position of said second element lying spaced from one another such that the magnetic fields of the magnets thereof act on said particles to align said particles and thereby alter the light transmission characteristics of said screen to form discrete discontinuous images of said elements with spacing therebetween, and means for retaining said second element in said second position thereof.

8. Apparatus according to claim 3 wherein said first and second elements in said first position of said second element lie adjacent one another such that the magnetic fields of the magnets thereof act on said particles to align said particles and thereby alter the light transmission characteristics of said screen to form a substantially continuous visible image of said elements without any substantial image of a juncture between said elements, said first and second elements in said second position of said second element lying spaced from one another such that the magnetic fields of the magnets thereof act on said particles to align said particles and thereby alter the light transmission characteristics of said screen to form discrete discontinuous images of said elements with spacing therebetween, and a body for overlying said surface, including means incooperable with said second element when disposed over said surface to displace said second element from said second position toward said first position.

9. Apparatus according to claim 1 wherein said scanner includes a permanent magnet mounted for movement along said scanner screen to align to the magnetically active particles in the dispersion medium such that the light transmission characteristics of said screen are substantially uniform across said screen whereby any image formed on the screen is erased.

10. Apparatus according to claim 1 wherein said scanner includes a second screen carrying a plurality of magnetically active particles in a dispersion medium such that, when said second screen overlies said surface with said first screen, said magnetic field acts on the particles carried by said second screen to align said particles and thereby alter the light transmission characteristics of said second screen to form a visible image of said element on said second screen, said second screen being removably mounted on said said scanner to provide a permanent record of the image formed on said second screen apart from the image formed on said first screen of said scanner.

11. Apparatus according to claim 1 including a plurality of elements carried by said member and underlying said surface with each element comprising a magnet for generating a magnetic field, each said magnet being shaped to form readily identifiable indicia, means for supporting said plurality of elements for movement to register discrete elements at a predetermined location along said surface such that, when said screen overlie said surface at said predetermined location, magnetic fields of said magnets carried by said elements act on said particles to align said particles and thereby alter the light transmission characteristics of said screen to form visible images of said elements on said screen.

12. Apparatus according to claim 1, wherein said member comprises a page of a book, said element being secured to said page of said book, said surface overlying said element and said page.

13. Apparatus according to claim 1, wherein said member comprises a toy doll, said magnetic element simulating in the toy doll a portion of a skeletal body of said doll visible as an image of said simulated skeletal body portion on said scanner screen.

14. Apparatus according to claim 1 wherein said scanner constitutes a part independent of said member and said element and which part is freely movable relative thereto.

15. Play apparatus comprising:

a doll body having an opaque surface;

an element carried by said doll body and underlying said surface such that said element is not visible through said surface, said element comprising a magnet for generating a magnetic field passing through said opaque surface; and a scanner including a support having a screen for overlying said surface and carrying a plurality of magnetically active particles in a dispersion medium, said magnetically active particles being responsive to said magnetic field, when said screen overlies said surface of said doll body, such that said magnetic field acts on said particles carried by said screen to align said particles and thereby alter the light transmission characteristics of said screen to form a visible image of said element on said screen.

16. Play apparatus according to claim 15 including a second element carried by said doll body and underlying said surface such that said second element is not visible through said surface, said second element comprising a magnet for generating a magnetic field passing through said opaque surface, said screen being of a size such that, when said screen overlies said surface, said magnetic field of said second magnetic element acts on said particles carried by said screen to align said particles and thereby alter the light transmission characteristics of said screen to form a visible image of said second element on said screen simultaneously with the formation of the visible image of the first-mentioned element, said magnetic elements being shaped to simulate a portion of a human skeletal frame whereby the visible image on said screen simulates a portion of a human skeletal frame.

17. A play apparatus according to claim 16 wherein said second element is movably mounted on said toy body for movement relative to said first element between a first position adjacent said first element and a second position spaced from said first element, said screen being of a size to overlie said surface with at least portions of said first and second elements forming an image on said screen when said second element lies in said first and second positions.

18. A play apparatus according to claim 17 wherein said first and second elements in said first position of said second element lie adjacent one another such that the magnetic fields of the magnets thereof act on said particles to align said particles and thereby later the light transmission characteristics of said screen to form a substantially continuous visible image of said elements without any substantial image of a juncture between said elements, said second element being detented in said first position and movable from said firs position into said second position in response to an impact against the toy body, said first and second elements in said second position of said second element lying spaced from one another such that the magnetic fields of the magnets thereof act on said particles to align said particles and thereby later the light transmission characteristics of said screen to form discrete discontinuous images of said elements with spacing therebetween, and means for retaining said second element in said second position thereof.

19. Image forming apparatus comprising:

a member having an opaque surface;

an element connected to and underlying said surface such that said element is not visible through said surface, said element comprising a magnetic means for generating a magnetic field through said opaque surface; and a scanner having a support and including a means for retaining a visible image of said magnetic means as a result of being in proximity to said magnetic field, said means for retaining a visual image including a screen carrying a plurality of magnetically active particles in a dispersion medium such that, when said screen overlies said surface, said magnetic field acts on said particles carried by said screen to align said particles and thereby alter the light transmission characteristics of said screen to form said visible image of said magnetic means on said screen.

20. Apparatus according to claim 19 wherein said magnetic means is shaped such that said visible image of said magnetic means on said screen conveys identifiable information.

* * * * *